US006629659B1

(12) United States Patent
Innala et al.

(10) Patent No.: US 6,629,659 B1
(45) Date of Patent: Oct. 7, 2003

(54) METHOD AND APPARATUS FOR MEASURING WEB TENSION PROFILE TO CONTROL THE REELING OF A WEB

(75) Inventors: Matti Innala, Järvenpää (FI); Teppo Kojo, Mäntsälä (FI); Mika Tammenoja, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/622,608

(22) PCT Filed: Feb. 17, 1999

(86) PCT No.: PCT/FI99/00124

§ 371 (c)(1),
(2), (4) Date: Oct. 6, 2000

(87) PCT Pub. No.: WO99/42392

PCT Pub. Date: Aug. 26, 1999

(30) Foreign Application Priority Data

Feb. 17, 1998 (FI) ..... 980362

(51) Int. Cl.[7] ..... B65H 23/022

(52) U.S. Cl. ..... 242/413.5; 242/541.1; 242/541.7

(58) Field of Search ..... 242/541.1, 541.4, 242/541.7, 413.1, 413.5, 413.6

(56) References Cited

U.S. PATENT DOCUMENTS

| | | | | |
|---|---|---|---|---|
| 3,687,388 A | | 8/1972 | Pfeiffer | |
| 3,837,593 A | * | 9/1974 | Dorfel | 242/534 |
| 3,858,820 A | * | 1/1975 | Crouse | 242/413.5 |
| 4,634,068 A | | 1/1987 | Malkki et al. | |
| 4,811,915 A | | 3/1989 | Smith | |
| 4,817,883 A | | 4/1989 | Hoffmann et al. | |
| 4,989,461 A | | 2/1991 | Nishiwaki et al. | |
| 5,052,233 A | | 10/1991 | Rantala | |
| 5,190,232 A | * | 3/1993 | Brandon et al. | 242/533.4 |
| 5,308,010 A | * | 5/1994 | Hakiel | 242/534 |
| 5,381,341 A | * | 1/1995 | Herrala | 700/129 |
| 5,611,500 A | * | 3/1997 | Smith | 242/541.4 |
| 5,649,448 A | | 7/1997 | Koskimies et al. | |
| 5,663,510 A | | 9/1997 | Niemann et al. | |
| 5,781,440 A | | 7/1998 | Adamy | |
| 5,898,589 A | * | 4/1999 | Shakespeare et al. | 162/198 |
| 5,918,830 A | * | 7/1999 | Verajankorva | 242/541.1 |
| 5,971,315 A | * | 10/1999 | Kojo | 242/534.2 |
| 6,106,177 A | * | 8/2000 | Siegl et al. | 101/228 |
| 6,200,422 B1 | * | 3/2001 | Shakespeare et al. | 162/198 |
| 6,231,722 B1 | * | 5/2001 | Vestola | 162/198 |
| 6,352,615 B1 | * | 3/2002 | Tavi et al. | 162/198 |

FOREIGN PATENT DOCUMENTS

| | | |
|---|---|---|
| EP | 0211313 | 4/1989 |
| EP | 0367901 | 5/1990 |
| EP | 0528517 | 2/1993 |
| EP | 0483093 | 1/1996 |
| JP | 58162458 | 9/1983 |
| WO | 9315008 | 8/1993 |

* cited by examiner

*Primary Examiner*—Kathy Matecki
*Assistant Examiner*—Sang Kim
(74) *Attorney, Agent, or Firm*—Steinberg & Raskin, P.C.

(57) ABSTRACT

A method and apparatus for reeling or winding of a web in which one or more factors affecting the web in the reeling or winding process are controlled by means of measurement data in order to affect the quality of the reel or roll formed in the reeling or winding process. The is measurement data used is the web tension profile of the web brought into the reeling. The web tension profile is measured by means of a measuring device from which the web tension profile data is transmitted to a data processing unit which adjusts the factors affecting the web during reeling or winding.

17 Claims, 5 Drawing Sheets

METHOD AND APPARATUS FOR MEASURING WEB TENSION PROFILE TO CONTROL THE REELING OF A WEB

FIELD OF THE INVENTION

The present invention relates to a method in the reeling or winding of a web, in which method one or more factors or manipulated variables affecting the web in the reeling or winding are controlled during the reeling or winding by means of measurement data in order to affect the quality of the reel or roll formed in the reeling or winding.

BACKGROUND OF THE INVENTION

In present-day reel-ups and intermediate reel-ups (rereelers) and slitter-winders, the reeling or winding is controlled indirectly by adjusting reeling parameters (linear load, web tension and circumferential/reeling force). The adjustment is typically conducted with a special program. The main objective of the reeling is to reel a roll from a continuous paper web, so that the roll meets the requirements set by the reeling process and further processing for processability and thereby for the structure of the roll as well as for the paper quality.

The properties of the web affect the quality of the roll. For example, the most common reeling problem caused by a poor web tension profile is the wrinkling of slack sections of the web, typically the edges, in the reeling nips, because the web is longer by the slack section than by the tense section. The slackness of the edges also produces a poor edge-zone structure in the roll, and results in edge rolls of poor quality, which are difficult to be wound by means of slitter-winders and which pose problems when used for example in printing machines. If the web tension profile is very fluctuating or e.g. one-sided, it can lead to the use of a high web tension to be quite sure, which loads the tense sections of the web more and increases the number of web breaks.

The structure of the roll is affected by manipulated variables of the reeling process, which typically include the linear load of the reeling nip, the circumferential force, and the web tension. The reeling of the paper web and its control by means of different variables are described for example in Finnish patent 89701 and in the corresponding European patent 483093. The control of the paper making process in a paper machine is also discussed more extensively in Finnish patent 94066, and in the corresponding U.S. Pat. No. 5,649,448. Here, a tension profile measurement provides information which is used to adjust the actuators which precede the measurement and affect the other transverse profiles of the web. Furthermore, publication JP-A-58162458 discloses a slitter-winder, in which the web is wound to form customer rolls. Here, the web tension is measured after unwinding, and it is displayed in a computer terminal, wherein the operator of the machine can set the values used in the unwinding to optimum.

OBJECTS AND SUMMARY OF THE INVENTION

The purpose of the invention is to present a reeling method, in which the properties of a web which is brought to reeling are better taken into account either in the reeling up of a full-width web or when winding a web to narrower customer rolls. To attain this purpose, the method according to the invention is primarily characterized in what will be presented in the characterizing part of the appended claim 1.

The invention comprises a control method for the reeling or winding process (e.g. reeling-up/intermediate reeling (rereeling), slitting/rewinding), in which method a web tension profile measurement is utilized to adjust the reeling or winding parameters and thereby the structure of the reel or roll to be reeled up or wound. The web tension profile is obtained in connection with the reeling up of a full-width web, i.e. web produced by a paper machine or a finishing machine for paper that has undergone a series of processing stages, in other words, it is possible to utilize the web tension profile information measured from the full-width web (the width of which, depending on the machine width, is several meters, typically over 4 meters). The variables to be adjusted in the reeling include for example the linear load of the reeling nip, the linear load profile, the center/circumferential drive and the web tension, or one or some of these. According to one embodiment, it is possible to profile a manipulated variable of the reeling or a factor affecting the web. For example the control of a spreading device, such as a spreader roll, preceding the reeling cylinder, also alleviates the problems of wrinkling in the reeling nip. By an active nip profile adjustment, it is also possible to control the effect of such local tension profile deviations on the structure of the web which are situated closer to the center of the web in the tranverse direction. It is also possible to adjust a suitable variable as a whole, for example the web tension level to reduce web breaks.

In slitter-winders, the need to adjust the structure of the roll due to a poor tension profile often pertains to edge rolls or individual rolls in the middle of the web. Center-drive slitter-winders enable a very accurate adjustment of the structures of individual rolls in each winding station. In the winding effected by the slitter-winder, it is possible to use, for example, the tension profile information from the reel-up of the full width web of the preceding process stage to adjust the reeling parameters.

The apparatus comprises at least a measuring device for the web tension profile, and a data processing unit which is arranged to process the information on the web tension profile and to control one or more controllers of the reeling or winding.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
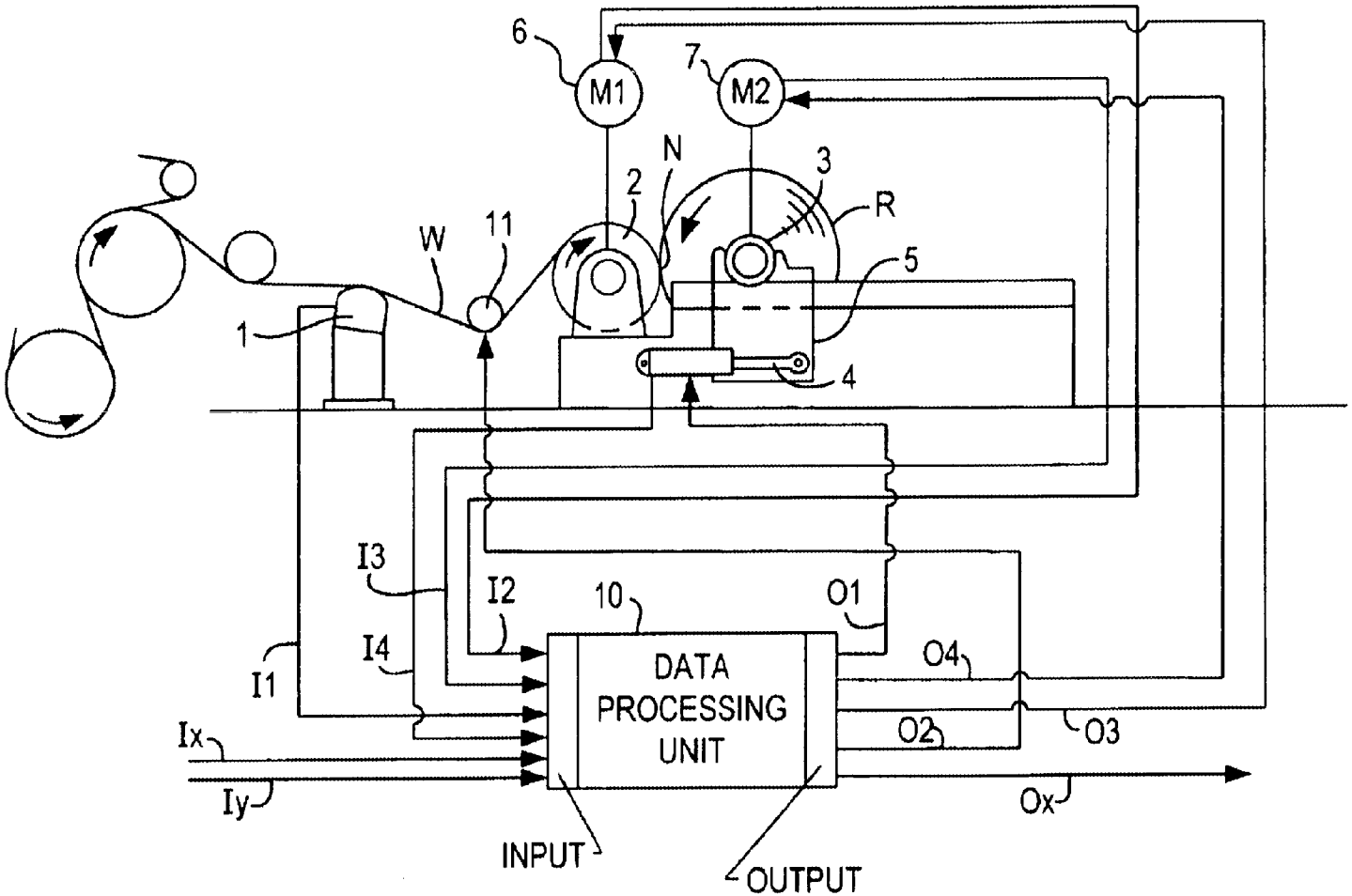
FIG. 1 shows the principle of the method according to the present invention in a diagram attached to a side-view of a reel-up.

FIG. 1 shows a reel-up which is arranged to form a machine reel R of a continuous full-width web W passed from the preceding paper machine sections. Instead of an actual paper making machine, the apparatus in question may also be a finishing machine for paper. The web travels via a tension profile measuring device 1 and a spreading device 11, which immediately precede the reel-up, to a reeling cylinder 2 of the reel-up, winds around it within a given sector and ends up onto the reel R via a reeling nip N. The reel is formed in a known manner around a reeling shaft, i.e. a reel spool 3, and the reel spool 3 is loaded with an adjustable force towards the reeling cylinder 2 in order to provide the reeling nip N with the desired linear load. The linear load can also be produced by loading the reeling cylinder, which is supported in a mobile manner, against a substantially stationary rotatable reel R (reel spool 3). The load is accomplished in practice with a force device 4, which is arranged in a power transmitting connection with the ends of the reel spool 3, for example by means of a reeling carriage 5 which is arranged mobile in the frame. The reeling cylinder 2 and the reel spool 3 are equipped with center drives, known as such, whose drive devices are marked with reference numerals 6 and 7 respectively. When the reel R grows, the carriage 5 simultaneously moves further away from the reeling cylinder 2, and when the reel has become full, it is removed and a new empty reel spool is brought to the reel-up by means of arrangements known as such, which will not be described in more detail in this context.

The force device 4 is typically an actuator which is driven by means of a pressurized medium and whose force can be adjusted by altering the pressure of the pressurized medium. Primarily hydraulic, but also pneumatic cylinders are possible.

As for the device 1 for measuring the tension profile of the web W, it is possible to use known devices which can conduct on-line measuring of the by-passing web. One such device is presented in Finnish patent 80522 and in the corresponding U.S. Pat. No. 5,052,233.

Furthermore, FIG. 1 shows a data processing unit 10, which is arranged to collect measurement data from different locations via data transmission lines, for example input messages 12 and 13 from the center drives 6 and 7, which messages can be for example the values of torque and rotational speed which are compared with the set value in the adjustment; and an input message 14 from the force device 4, such as a pressure which indicates the linear load in nip N. The unit 10 can be supplied with input messages also from other parts of the process, for example from the process stages before the reeling, these input messages and the corresponding data transmission lines being marked with letters Ix and Iy.

As shown the data processing unit 10 is arranged to receive an input message I1 from the device 1 which continuously measures the tension profile, the input message I1 containing information on the tension profile of the web W that enters the reeling process.

The data processing unit 10 is arranged to process input messages and to control different reeling parameters. For this purpose, the different controllers are provided with data transmission lines. An output message O1 controls the force generated by the force device 4 and thereby the linear load in the reeling nip N; an output message O2 controls the effect directed to the web W by the spreading device 11, i.e. the bowing of the spreader roll; an output message O3 controls the drive of the reeling cylinder 2; and an output message O4 controls the drive of the reel spool 3. Other possible output messages are marked with the letter Ox. Thus, an automatic control of the reeling parameters is achieved according to predetermined principles.

On the basis of the tension profile information, a factor affecting the web W is profiled in the transverse direction of the web W in particular, by utilizing the methods available. As for the spreading device 11, this means that the web W is guided (spread) with the spreading device, which can be a spreader roll, a turning shoe functioning by means of air foils, or another corresponding spreading device.

Profiling can be performed in the reeling nip N as well. In the reeling, there are several ways of affecting the load distribution in the reeling nip N in the lateral i.e. transverse direction of the web W on the basis of information received on the tension profile. By altering the load effected through the ends of the reel spool, a certain load distribution is always produced. Here, it is also possible to use a variable crown roll.

Figure 2:
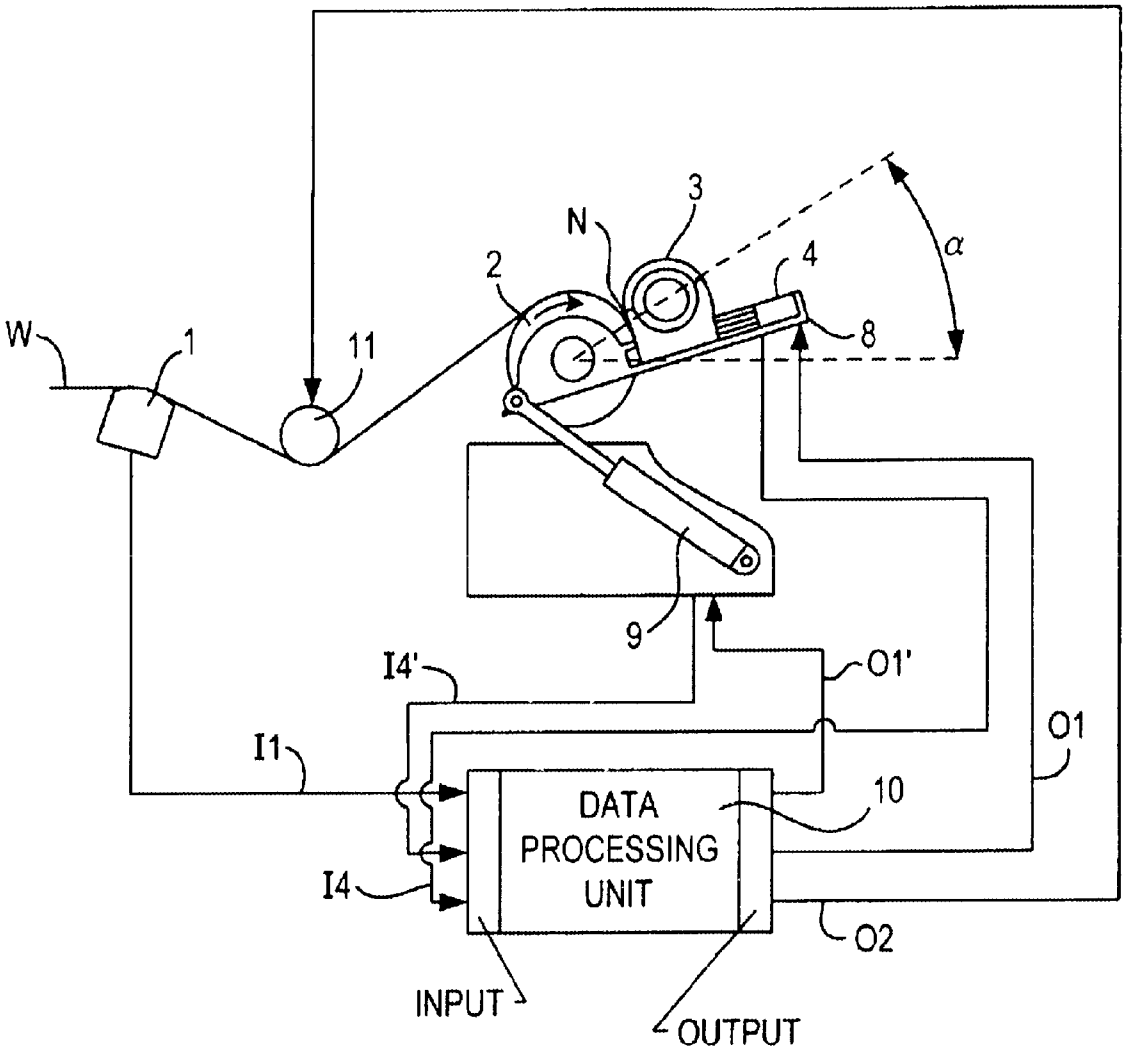
FIG. 2 shows the application of the method in a reel-up structure.

FIG. 2 presents a solution, in which the parts similar to the parts in FIG. 1 are marked with the same reference numerals. The reel-up is of such a type in which the linear load in the reeling nip N is affected by a so-called angle reeling in which the reel spool 3 is supported at its ends by arms 8 which are arranged pivotable in the vertical plane and are moved by an actuator 9, which sets the reeling angle a to a desired value. The angle a determines, in a known manner, the linear load in the nip N due to the weight of the reel spool 3 and the web wound around it, in addition to which the load or relief force can be adjusted by means of force devices 4 which are fixed to the arms 8 and connected to the ends of the reel spool 3 and are capable of increasing or relieving the load. This so-called angle reeling solution is disclosed in. Finnish patent 89701. By means of the angular position of the reel spool and the load/relief effected at the ends, it is also possible to profile the linear load.

Figure 3:
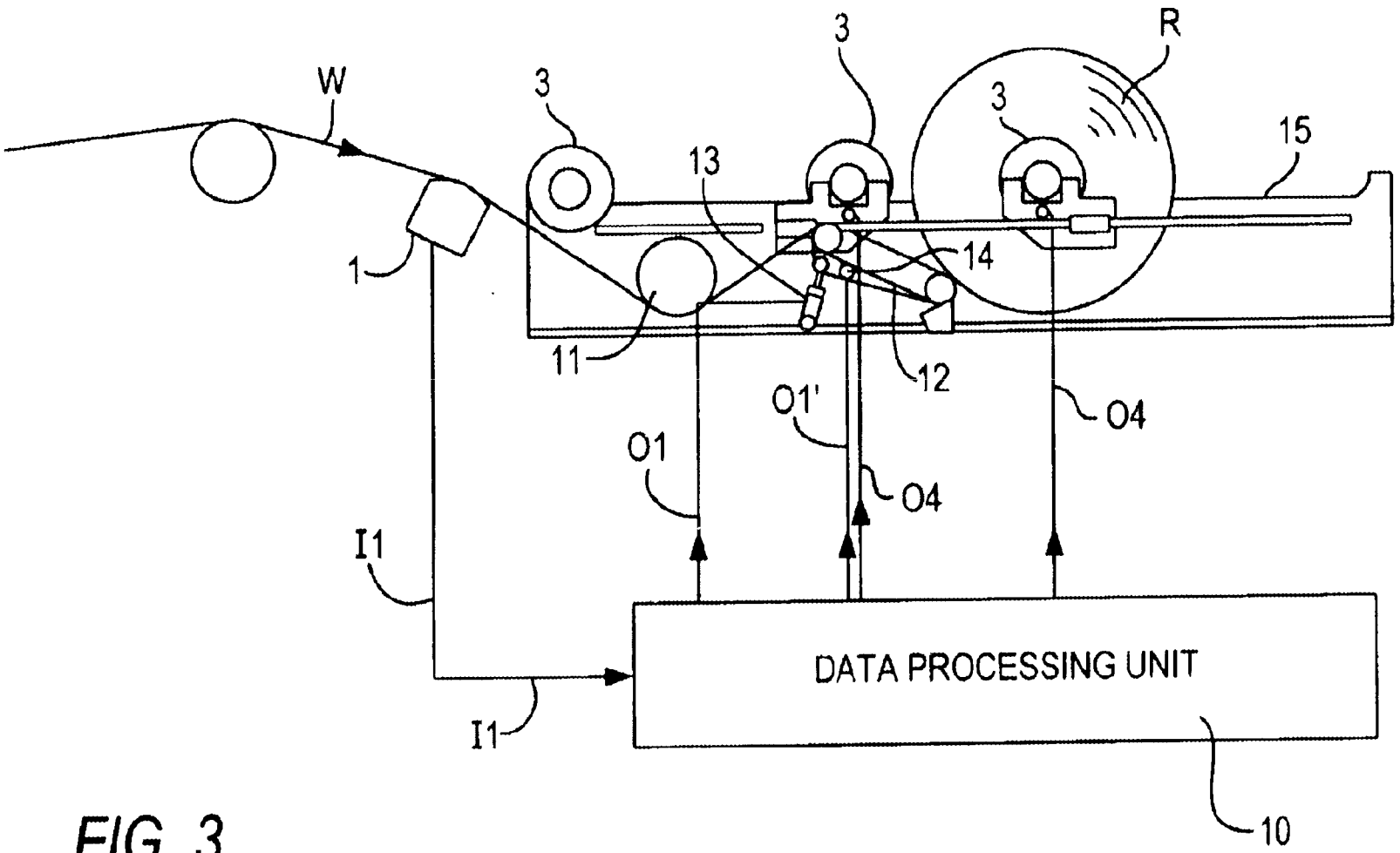
FIG. 3 shows the application of the method in another reel-up structure.
Figure 4:
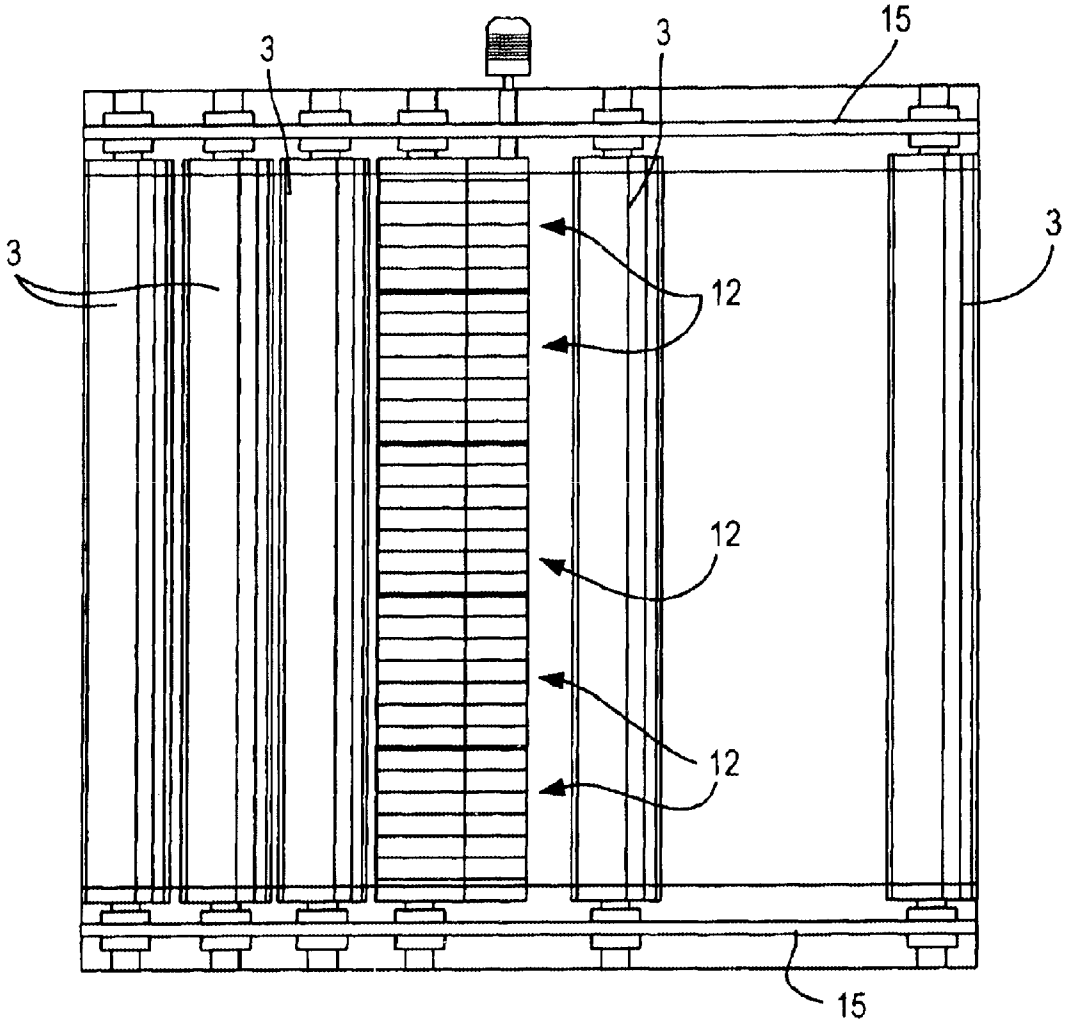
FIG. 4 shows the structure of the reel-up of FIG. 3 widthwise.

FIG. 3 shows a reel-up type, a so-called belt support reel-up, in which the reeling nip N is produced by means of a belt and rolls system 12, which is pressed with a force device 13 against the reel R being formed. The belt can also comprise means 14 for adjusting the tension, whereby it is possible to adjust the tension of the belt in contact with the reel R. By means of the web tension profile information it is possible to adjust the load effected by the force device 13 and/or the means 14 for adjusting the tension (output message O1 and O1'). The reel spool 3 is supported by reeling rails 15, along which the empty reel spools 3 are also brought to a change position. Furthermore, FIG. 4 shows the structure of the reel-up widthwise. There are several belt and rolls systems 12 over the width of the web W and the reel R, and they are equipped with force devices 13 and means 14 for adjusting the tension of their own. The load effected by these devices and means can be set individually. Thus, the reeling nip N can be provided with the desired linear load distribution according to the measured tension profile.

The reel to be formed can be supported and loaded also in another manner than the one presented above. It is also possible to use other reel-up types besides those presented above. Corresponding ideas can well be applied in pressure roller reel-ups as well. The invention can also be applied in winders following the slitter, such as carrier drum winders. In connection with the slitter-winders, it is most advantageous to utilize the tension profile information of the web that is measured already in connection with the reeling of an intermediate reel formed of a full-width web, which tension profile information is stored in the central processing unit 10. By means of this stored information it is possible to control the aforementioned parameters in each winder following the slitter.

In this context, the reeling nip N refers to an area that more or less extends in the longitudinal direction of the web W, and in which there is a load, e.g. the point at which the mantle of the reeling cylinder is in contact with the reel, or the point at which the belt of a belt and rolls system is in contact with the roll R.

Figure 5:
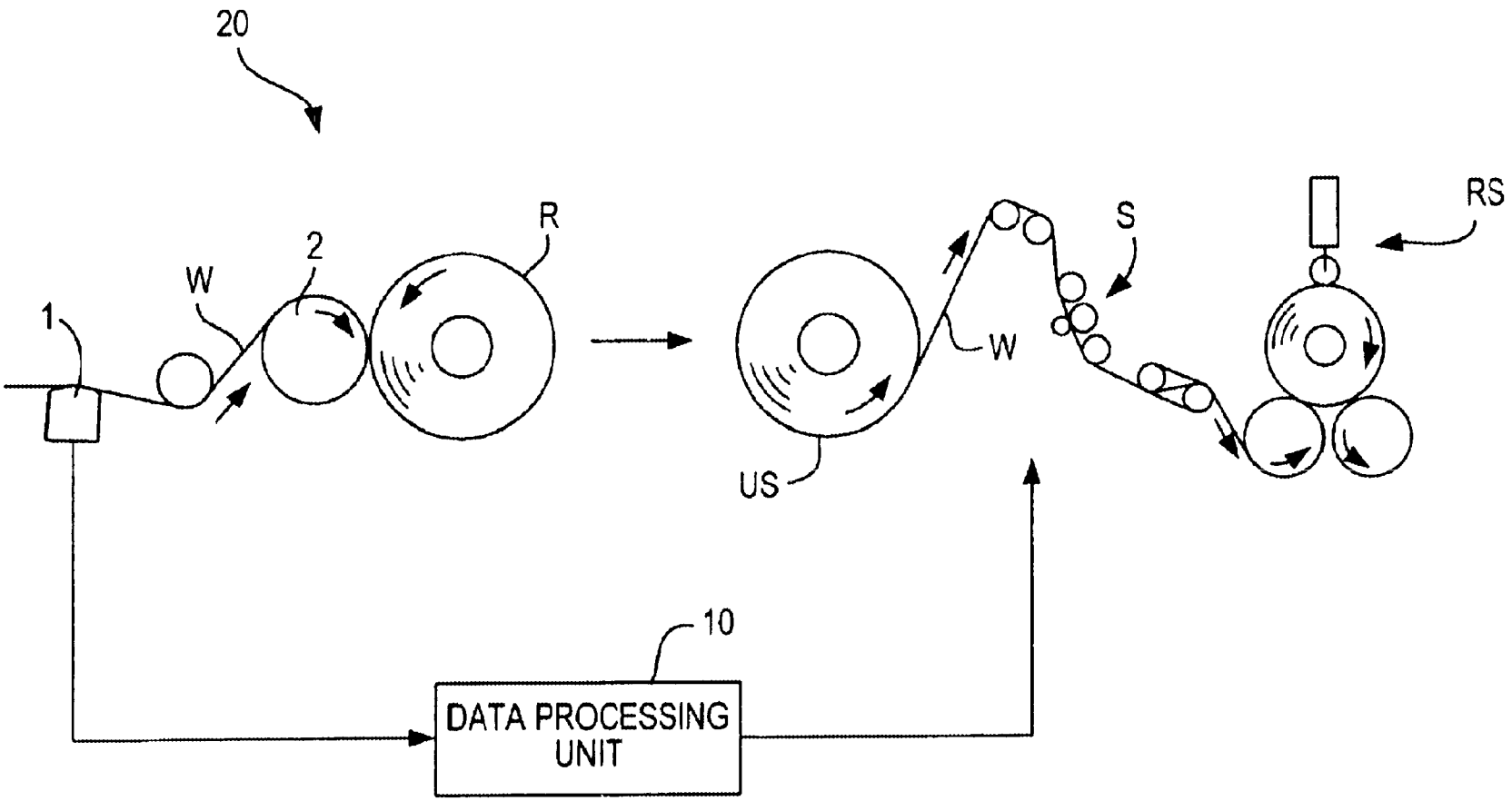
FIG. 5 shows the application of the method in a paper machine.

In winding in the slitter it is possible to monitor the web tension profile of each web running onto the respective roll by means of an on-line measuring device 1, and to correct the winding parameters of each roll when necessary. As shown in FIG. 5, a paper machine 20 may be provided with a measuring device 1, a data processing unit 10, a reel R, a slitter S and a rewinding station RS. In this arrangement measurement data is obtained from the web tension profile stored in a connection with the reeling state at R ("the preceding reeling stage") and is used for profiling of the factors or manipulated variables affecting the web when unwinding the web at undwinding station US. Thereafter, as shown in FIG. 5, the web passes through a slitter S and then is rewound in rewinding station RS.

The rolls that are delivered to a customer can be accompanied with the tension profile information of the corresponding web, stored in a suitable way, for example on a diskette to be read electrically or optically, or in the form of a digital bar code e.g. on a label or elsewhere in connection with the roll. The customer rolls that are wound after the slitter can be accompanied with the tension profile information of the web of the intermediate reel in the corresponding location in the transverse direction of the web, with the web tension profile information obtained in the winding of the customer roll itself, or with both of them in any of the aforementioned formats. The information that accompanies the customer rolls can contain the average value of the tension profile for the entire duration of the reeling/winding or more information, e.g. the variation of the tension profile as a function of time or the meters reeled or wound.

The invention is applicable for the reeling or winding of all web-like materials, especially paper web. In this context, the paper web refers to all continuous web-like materials that are produced of fibrous material, irrespective of their grammage.

What is claimed is:

1. A method for the reeling or winding of a web, in which method one or more factors or manipulated variables affecting the web in a reeling or winding process are controlled during the reeling or winding by means of measurement data in order to affect the quality of the reel or roll formed in the reeling or winding, said method comprising the steps of:

defining a point for a web tension profile measurement;

measuring at said point for the web tension profile measurement the web tension profile of a full width web, said full width web is reeled to provide web tension information;

processing of said web tension profile information of said full width web to be reeled by means of a data processing unit;

converting said web tension profile information by said data processing unit into at least one control signal for each of said factors or manipulated variables of said reeling or winding process; and profiling of said factors or manipulated variables of said reeling or winding process affecting said web at a point in a direction of travel of the web after the point of web tension profile measurement in a transverse direction to said web by means of said web tension profile information.

2. The method according to claim 1, wherein said factors or manipulated variables to be profiled is an effect which is applied to the web by a spreading device.

3. The method according to claim 1, wherein said factors or variables to be profiled is a linear load affecting a reeling nip, whereby a linear load profile is obtained.

4. The method according to claim 1, wherein said measurement data is obtained from said web tension profile measurement conducted substantially right before said reeling of said web.

5. The method according to claim 1, wherein said measurement data is obtained from said web tension profile stored in connection with a preceding reeling stage, whereby it is used for profiling of said factors of manipulated variables affecting said web in a transverse direction to said web when unwinding said reel which was reeled in said preceding reeling stage and when rewinding said web obtained thereby.

6. The method according to claim 5, wherein said rewinding is a winding process which takes place after a slitter of said web.

7. The method according to claim 1, wherein said factor or manipulated variable effective in said reeling or winding is at least one of:

a linear load in a reeling nip;

a load or relief directed to the ends of a reel spool by means of a force device;

an angle of an angle reeling; and a spreading effect caused by a spreading device.

8. The method according to claim 1, wherein said tension profile is measured from said paper web after drying of said paper web.

9. The method according to claim 8, further comprising the steps of:

running said paper web passing from a paper manufacturing line, in said reeling process, via a tension profile measuring device;

passing said paper web via a spreading device; and guiding said paper web onto said reel.

10. The method according to claim 1, wherein during said reeling process, a machine reel is formed of said paper web in connection with a paper machine.

11. An apparatus in the reeling or winding of a web, comprising:

a measuring device structured and arranged to measure a web tension profile of a full width web to be reeled; and a data processing unit connected to a reeling or winding device and arranged to process said web tension profile produced by said measuring device and to convert said profile into at least one control signal which effects a profiling of a factor or manipulated variable of the reeling or winding affecting said web in a transverse direction to said web at a point in a direction of travel of the web after said measuring device.

12. The apparatus according to claim 11, wherein said data processing unit is connected to said measuring device which measures an on-line measurement of said web tension profile of said web running to said reeling process.

13. The apparatus according to claim 12, wherein said measuring device is located substantially immediately before said reeling device.

14. The apparatus according to claim 13, wherein said data processing unit is connected to at least one controller in an unwinding or rewinding device which is arranged to unwind said reel having been reeled in a preceding reeling stage and to rewind it to form a roll, wherein said data processing unit is arranged to receive said web tension profile information obtained in said preceding reeling stage.

15. The apparatus according to claim 14, wherein said unwinding and rewinding device is a winding device located in connection with a slitter-winder of said web.

16. An apparatus according to claim 11, wherein said data processing unit is connected to said controllers of at least one of said following factors or manipulated variables effective in said reeling:

a linear load in a reeling nip;

a load or relief directed to the ends of a reel spool by means of a force device;

an angle of an angle reeling; and a spreading effect caused by a spreading device.

17. An apparatus according to claim 11, wherein said measuring device is structured and arranged to measure said web tension profile of a paper web before a reeling device of said paper web.

* * * * *